US011162308B2

(12) United States Patent
Stankovic et al.

(10) Patent No.: US 11,162,308 B2
(45) Date of Patent: Nov. 2, 2021

(54) TUBULAR HANDLING APPARATUS

(71) Applicant: Weatherford Technology Holdings, LLC, Houston, TX (US)

(72) Inventors: Igor Stankovic, Gehrden (DE); Martin Helms, Burgdorf (DE); Michael Schindel, Langenhagen (DE); Thomas Kotschy, Burgdorf (DE); Christian Kiess, Hannover (DE)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/210,107

(22) Filed: Dec. 5, 2018

(65) Prior Publication Data

US 2020/0181991 A1 Jun. 11, 2020

(51) Int. Cl.

| | |
|---|---|
| ***E21B 19/07*** | (2006.01) |
| ***E21B 19/10*** | (2006.01) |
| ***E21B 19/20*** | (2006.01) |
| ***E21B 19/087*** | (2006.01) |

(52) U.S. Cl.

CPC ..... *E21B 19/07* (2013.01); *E21B 19/10* (2013.01)

(58) Field of Classification Search

None

See application file for complete search history.

(56) References Cited

U.S. PATENT DOCUMENTS

| | | | | |
|---|---|---|---|---|
| 7,775,572 | B2 * | 8/2010 | Slack | E21B 19/06 294/86.15 |
| 7,874,352 | B2 * | 1/2011 | Odell, II | E21B 19/10 166/77.51 |
| 8,157,004 | B2 * | 4/2012 | Matherne, Jr. | E21B 43/10 166/77.51 |
| 8,365,834 | B2 * | 2/2013 | Liess | E21B 19/06 166/382 |
| 8,893,772 | B2 * | 11/2014 | Henderson | E21B 19/02 166/77.1 |

FOREIGN PATENT DOCUMENTS

WO 2009135223 A2 11/2009

OTHER PUBLICATIONS

Combined Exam and Search Report in related application GB1917749.2 dated Aug. 21, 2020.

* cited by examiner

*Primary Examiner* — Matthew Troutman
*Assistant Examiner* — Douglas S Wood
(74) *Attorney, Agent, or Firm* — Patterson + Sheridan, LLP

(57) ABSTRACT

A tubular handling assembly includes a mandrel; a plurality of gripping elements for gripping a tubular, the plurality of gripping elements coupled to and rotatable with the mandrel; one or more accumulators; a first actuator configured to supply fluid to the one or more accumulators; and a second actuator configured to receive fluid from at least one of the one or more accumulators and to actuate the plurality of gripping elements.

23 Claims, 8 Drawing Sheets

TUBULAR HANDLING APPARATUS

BACKGROUND OF THE INVENTION

Field of the Invention

Embodiments of the disclosure generally relate to an apparatus for handling tubulars. More particularly, embodiments of the present disclosure relate to an actuator for operating a tubular handling apparatus for engaging a tubular and rotating the tubular.

Description of the Related Art

In the drilling and completion of wells, top drive systems are used to rotate a drill string to form a borehole. Top drive systems may also be used in a drilling with casing operation to rotate the casing. Top drives require a gripping element to facilitate the gripping of tubulars, whether the tubular is a drill string or a casing, and therefore, there is a need for an apparatus for adapting the top drive and engaging and rotating a tubular.

SUMMARY OF THE INVENTION

In one embodiment, a tubular handling assembly includes a mandrel; a plurality of gripping elements for gripping a tubular, the plurality of gripping elements coupled to and rotatable with the mandrel; one or more accumulators; a first actuator configured to supply fluid to the one or more accumulators; and a second actuator configured to receive fluid from at least one of the one or more accumulators and to actuate the plurality of gripping elements.

In another embodiment, a method of handling a tubular includes supplying fluid from a first actuator to an accumulator; supplying fluid from the accumulator to activate a second actuator; using the second actuator to activate a third actuator; moving a plurality of gripping elements into engagement with the tubular; and supplying fluid from the accumulator to increase a pressure of the third actuator.

In another embodiment, a method of handling a tubular includes supplying fluid from a first actuator to a first accumulator and a second accumulator; supplying fluid from the first accumulator to activate a second actuator; using the second actuator to activate a third actuator; moving a plurality of gripping elements into engagement with the tubular; and supplying fluid from the second accumulator to deactivate the second actuator.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
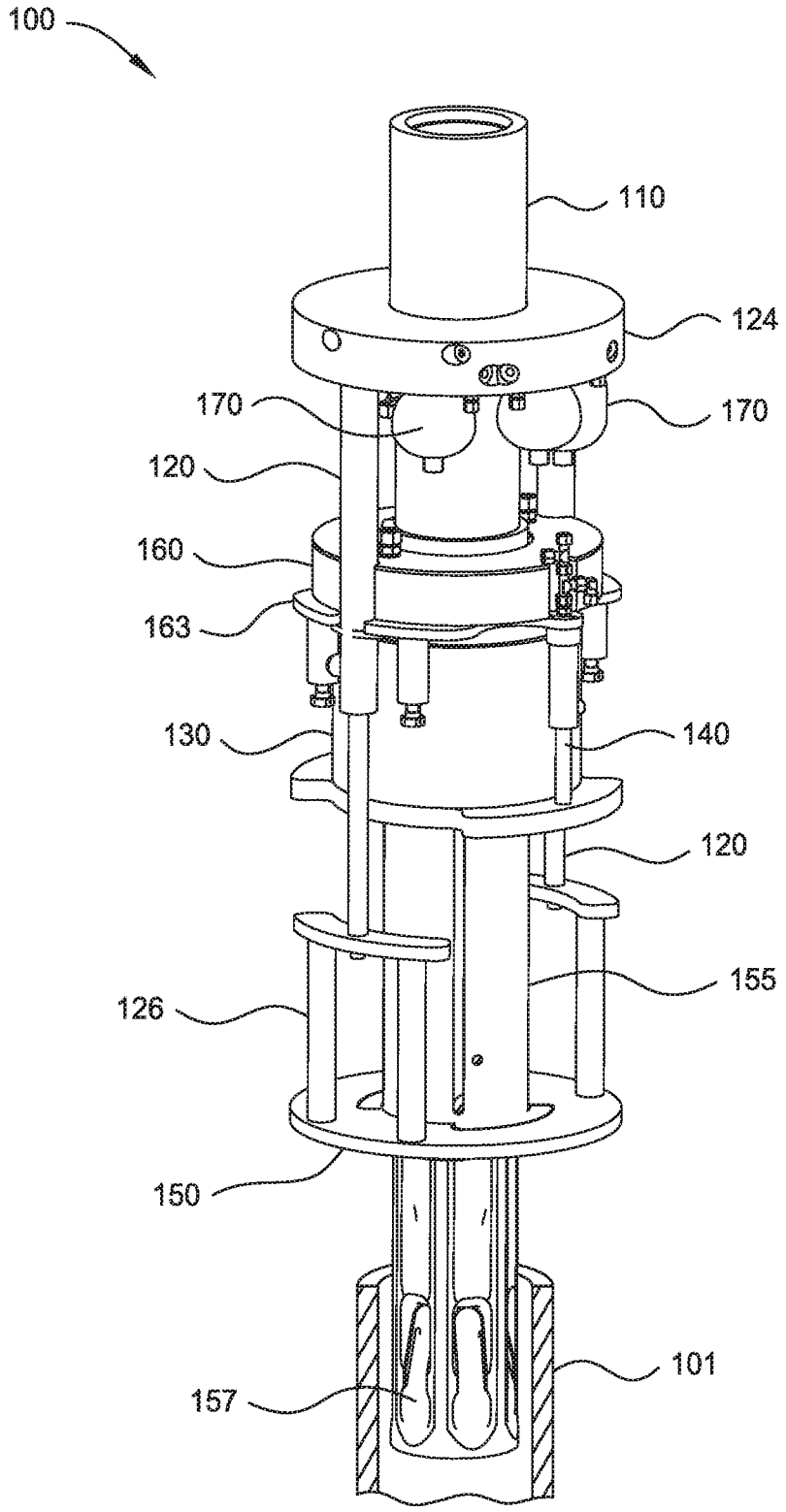
FIG. 1 is a perspective view of an embodiment of a tubular handling apparatus adapted to engage an internal surface of the tubular.
Figure 2:
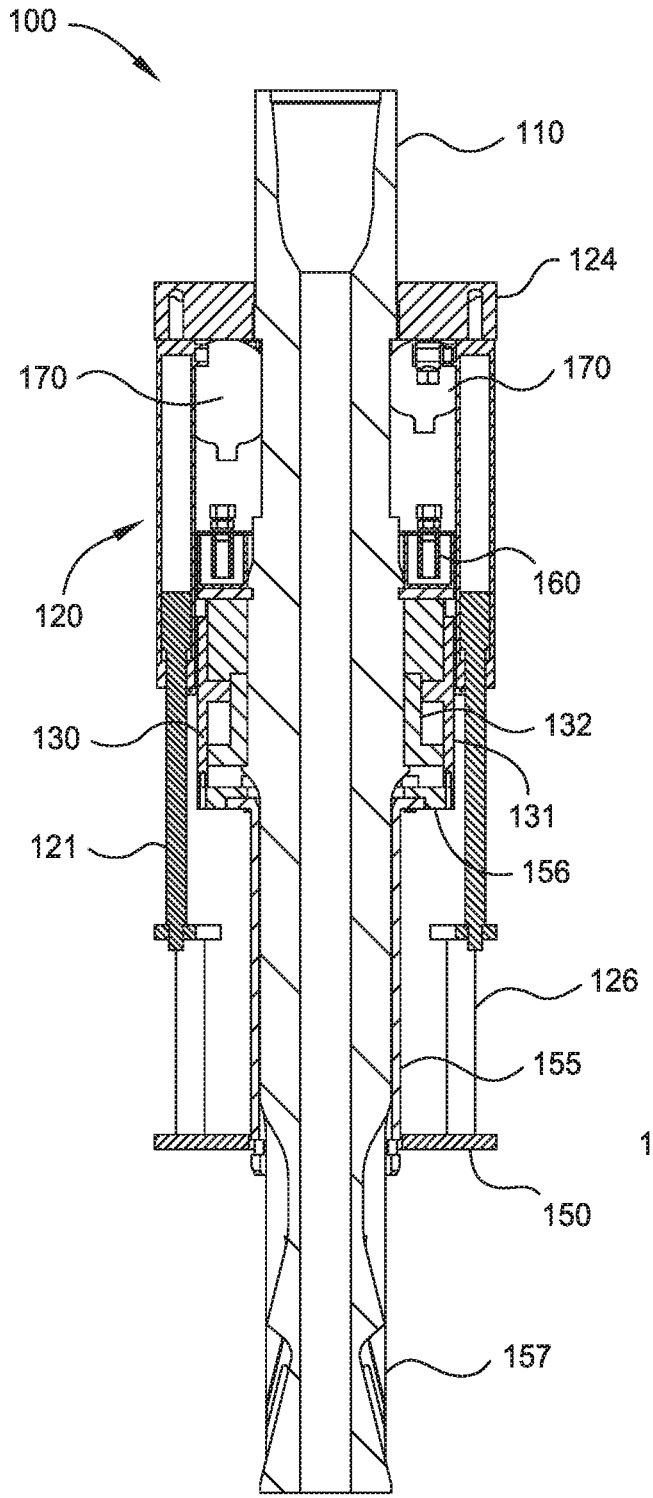
FIG. 2 is a cross-sectional view of the tubular handling apparatus of FIG. 1.
Figure 3:
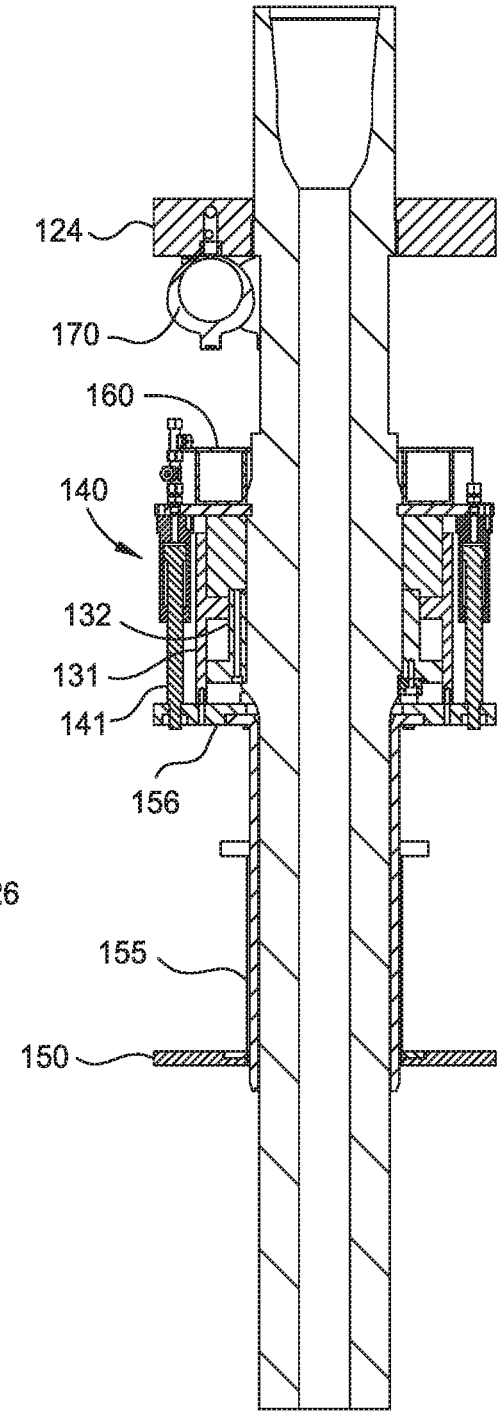
FIG. 3 is a cross-sectional view of the tubular handling apparatus rotated 90° from FIG. 2.

Embodiments of the disclosure provide a tubular handling apparatus for engaging and rotating a tubular such as a casing. FIG. 1 is a perspective view of an embodiment of a tubular handling apparatus 100 adapted to engage an internal surface of the tubular, and may be referred to herein as an internal gripping tool. FIG. 2 is a cross-sectional view of the tubular handling apparatus 100 of FIG. 1. FIG. 3 is a cross-sectional view of the tubular handling apparatus 100 rotated 90° from FIG. 2. The tubular handling apparatus 100 generally includes a mandrel 110 for connecting to a top drive and rotating the tubular, a pair of activating cylinders 120 for moving an engagement plate 150, a pair of setting cylinders 140, a plurality of gripping elements 157, a clamping cylinder 130 for actuating the gripping elements 157, a tank 160 for storing hydraulic fluid, and a plurality of accumulators 170. While an internal gripping tool is described, the tubular handling apparatus may be an external gripping tool configured to grip an outer surface of the tubular.

The upper end of the mandrel 110 includes threads for attaching to a drive shaft of a top drive. A plurality of gripping elements 157, such as slips, is disposed on an outer surface at the lower end of the mandrel 110.

A pair of first actuators, such as activating cylinders 120, is connected to the mandrel 110 via attachment to a support ring 124 that is attached to the mandrel 110. The engagement plate 150 is connected to a lower end of the piston 121 of the activating cylinder 120. In this embodiment, a plurality of connector bars 126 are connected between the piston 121 and the engagement plate 150. FIG. 1 shows the piston 121 in the extended position. An optional spring can be disposed in the activating cylinder 120 to facilitate extension of the piston 121. The activating cylinders 120 are in selective fluid communication with the tank 160 and the accumulators 170. The plurality of accumulators 170 are attached to the support ring 124. The tank 160 is attached to the mandrel 110. While two activating cylinders 120 are shown, any suitable number of cylinders, such as one, three, four, five, or more cylinders may be used, or any suitable actuator may be used. In another embodiment, the tank 160 is directly attached to the clamping cylinder 130.

A second actuator, such as an annular clamping cylinder 130, is disposed around the mandrel 110. In this embodiment, the clamping cylinder 130 is disposed below the tank 160. A support plate 163 is disposed between the tank 160 and the clamping cylinder 130. The clamping cylinder 130 includes an annular rod 131 surrounding an inner housing 132. The clamping cylinder 130 is in selective fluid communication with the tank 160 and at least one of the accumulators 170. An actuator plate 156 is attached to the lower end of the annular rod 131. In this respect, extension or retraction of the annular rod 131 moves the actuator plate 156 relative to the mandrel 110.

A pair of third actuators, such as setting cylinders 140, is connected between the support plate 163 and the actuator plate 156. The setting cylinders 140 are in selective fluid communication with the tank 160 and the accumulators 170. Extension or retraction of the pistons 141 of the setting cylinders 140 moves the actuator plate 156 relative to the mandrel 110. Extension or retraction of the pistons 141 of the setting cylinders 140 also extends or retracts the annular rod 131. In one embodiment, the setting cylinders 140 and the clamping cylinder 130 are integrated into a single cylinder, for example, an annular cylinder.

The upper end of the actuator sub 155 is attached to the actuator plate 156. The actuator sub 155 may be a tubular that is disposed around the mandrel 110. The lower end of the actuator sub 155 is attached to a plurality of gripping elements 157 such as slips. The gripping elements 157 can be extended outwardly by moving the gripping elements 157 along ramps on the mandrel 110.

Figure 10:
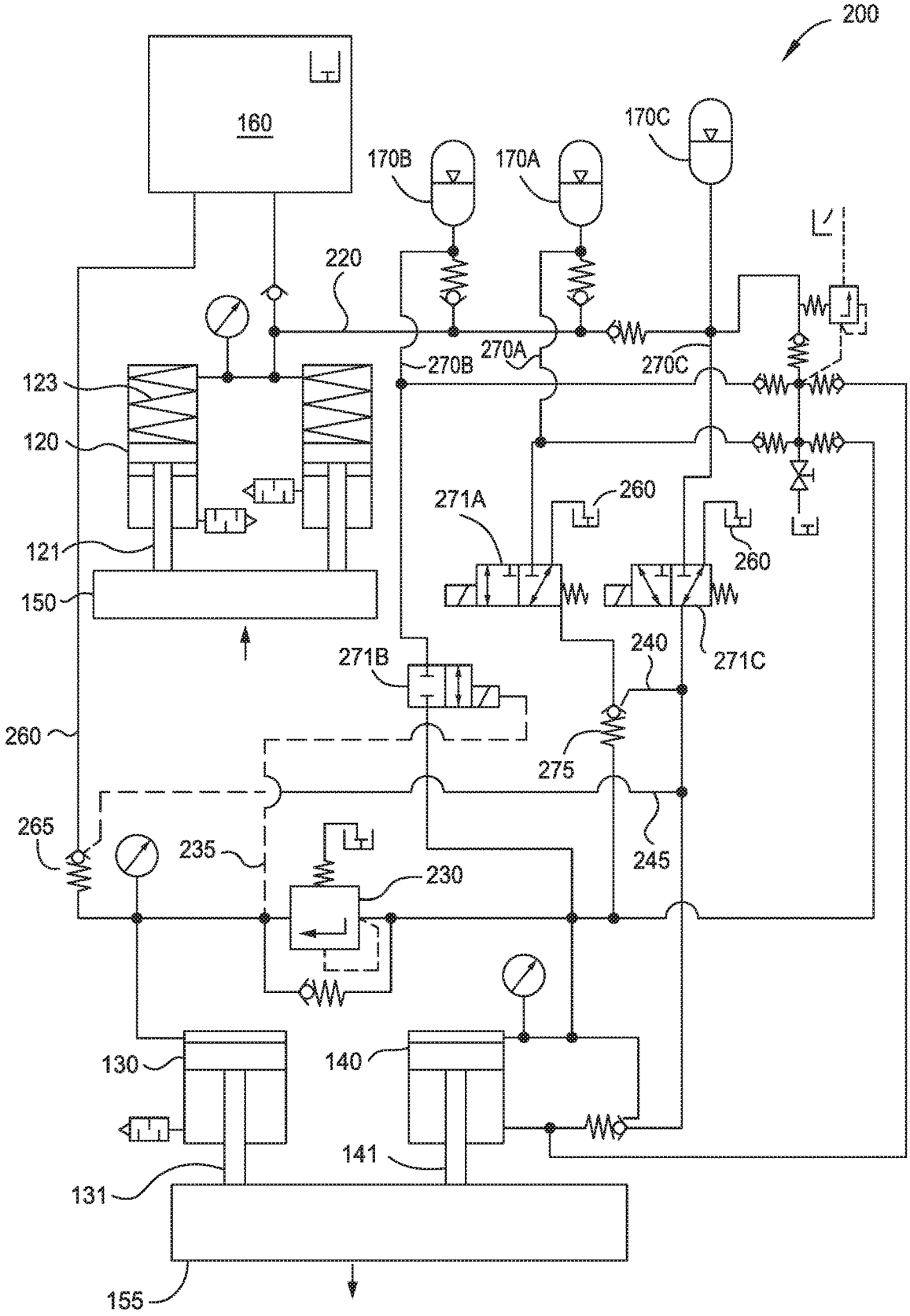
FIG. 10 shows an exemplary hydraulic circuit for the operation of the tubular handling apparatus of FIG. 1.

FIGS. 1-3 show the tubular handling apparatus 100 in the unactuated position. The tubular handling apparatus 100 is connected to the drive shaft of the top drive. The apparatus 100 contains an internal supply of hydraulic fluid to support its operation. The apparatus 100 may be connected to an optional outside source of hydraulic fluids. As shown, the pistons 121 of the activating cylinder 120 are fully extended, and the activating cylinders 120 are supplied with hydraulic fluid from the tank 160. The accumulators 170 do not contain any hydraulic fluid. FIG. 10 shows an exemplary hydraulic circuit 200 for the operation of the tubular handling apparatus 100. In the circuit 200, the accumulators 170 are individually referred to as 170A, 170B, and 170C. In one embodiment, the tubular handling apparatus 100 is operated by a controller, such as a handheld remote control. In another embodiment, the accumulators may contain some hydraulic fluid. In some embodiments, one, two, four, five, or more accumulators may be used. In one embodiment, the circuit 200 is a closed fluid circuit.

Figure 4:
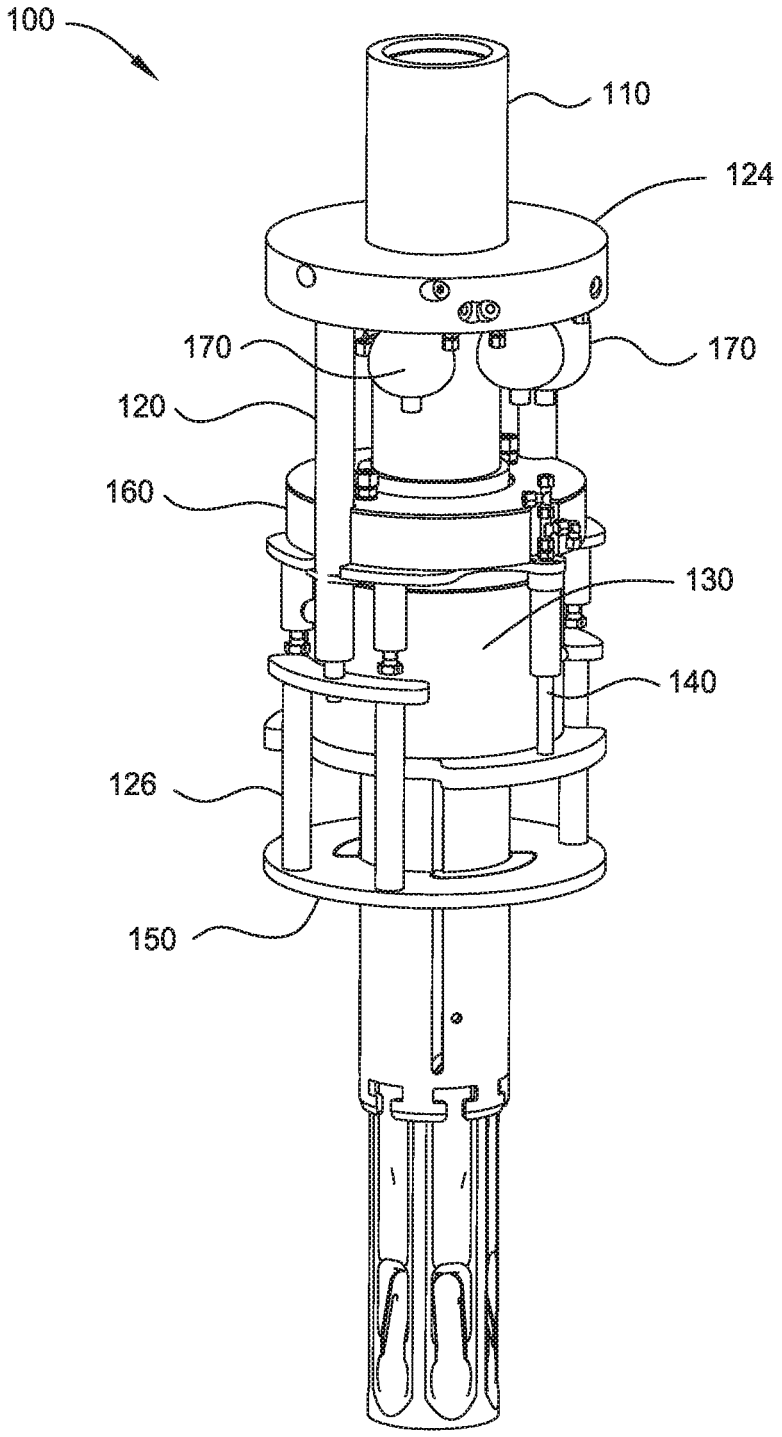
FIG. 4 shows the activating cylinders of the tubular handling apparatus of FIG. 1 in the retracted position.
Figure 5:
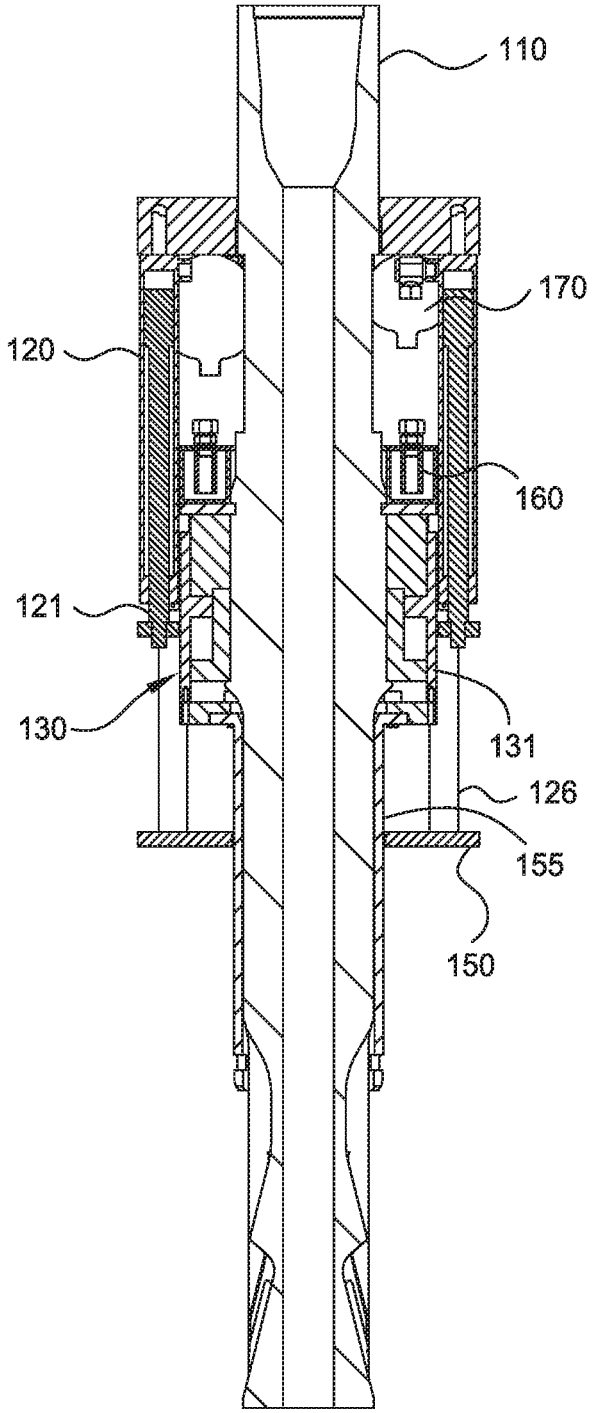
FIG. 5 is a cross-sectional view of the tubular handling apparatus of FIG. 4.
Figure 6:
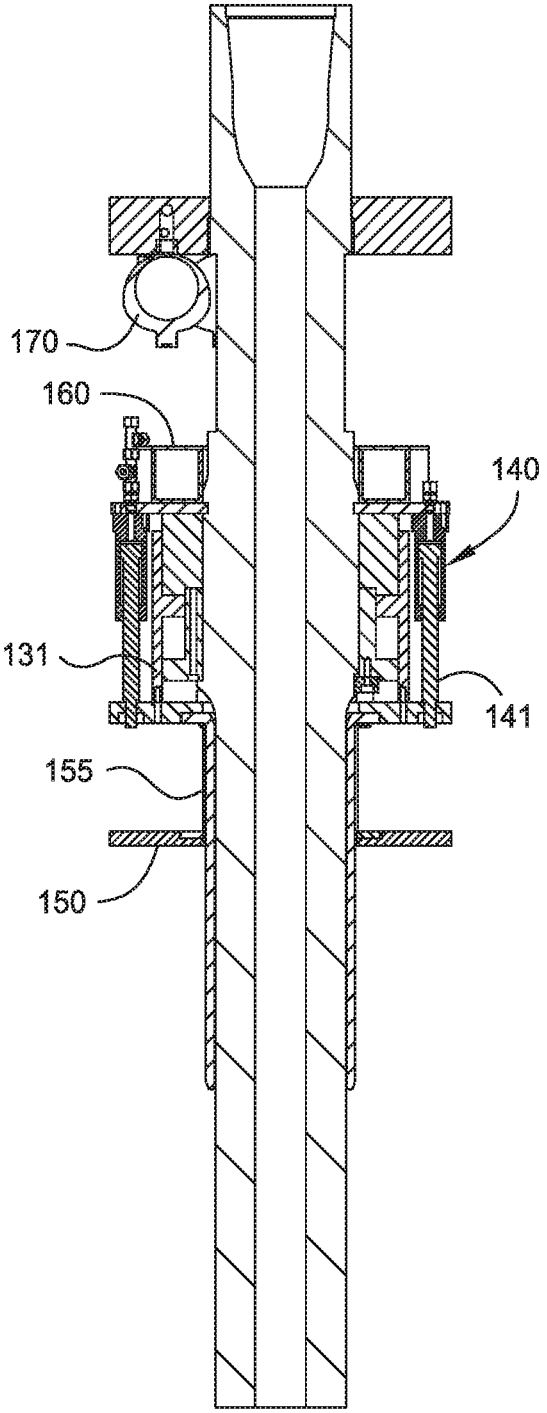
FIG. 6 is a cross-sectional view of the tubular handling apparatus rotated 90° from FIG. 5.

To grip a tubular 101, the top drive lowers the tubular handling apparatus 100 toward the tubular 101, and the gripping elements 157 are inserted into the tubular 101. The apparatus 100 is lowered until the engagement plate 150 contacts the tubular 101. Thereafter, the top drive applies additional downward force to compress the activating cylinders 120 against the tubular 101, thereby retracting the pistons 121. FIG. 4 shows the pistons 121 of the activating cylinders 120 in the retracted position. FIG. 5 is a cross-sectional view of the tubular handling apparatus 100 of FIG. 4. FIG. 6 is a cross-sectional view of the tubular handling apparatus 100 rotated 90° from FIG. 5. As the pistons 121 retract, hydraulic fluid in the activating cylinders 120 is forced out of the activating cylinders 120 and is directed toward the accumulators 170A, 170B, 170C via fluid line 220. A piston sensor may be used to determine the pistons 121 have retracted. In one embodiment, the pistons 121 are not fully retracted to prevent a "wedge lock" of the gripping elements 157. One or more pressure sensors may be used to determine the accumulators 170A-C have reached the pressure required to operate the other cylinders, such as the setting cylinders 140 and the clamping cylinder 130. In one embodiment, the piston sensors and the pressure sensors are battery powered.

Figure 7:
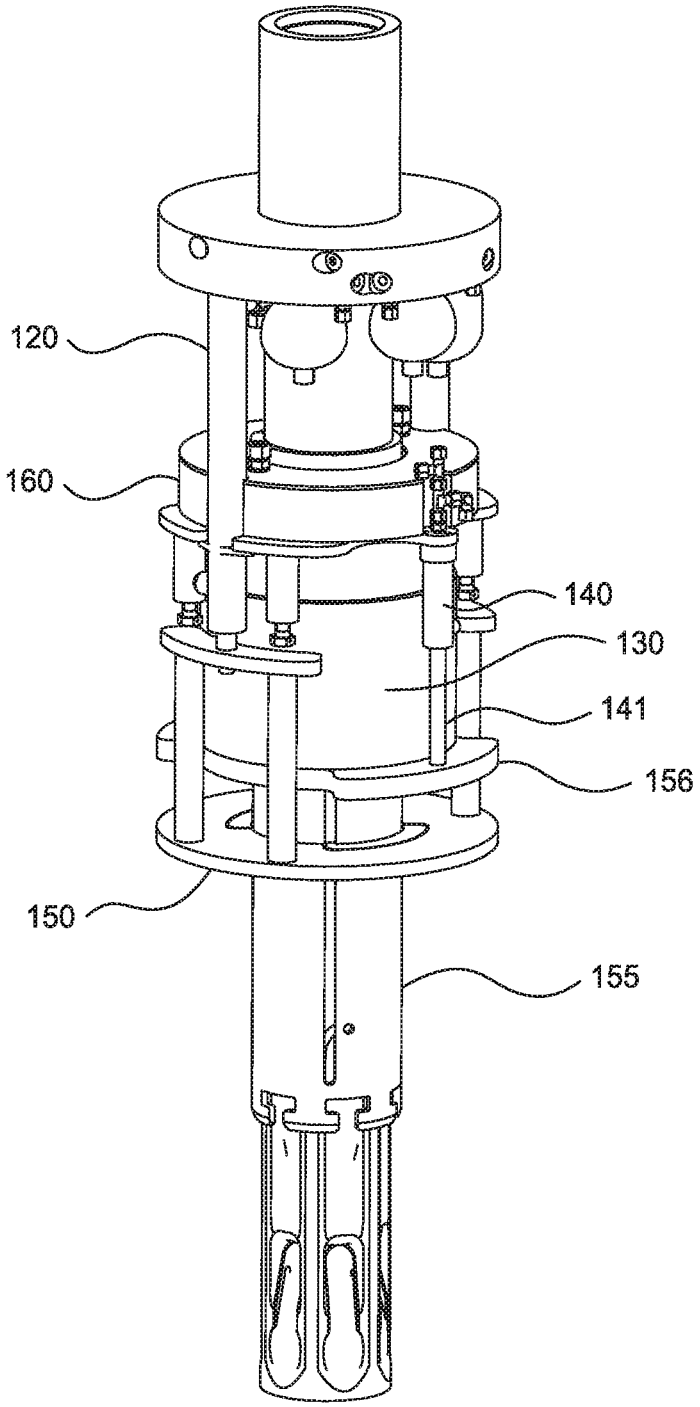
FIG. 7 shows the setting cylinders of the tubular handling apparatus in the extended position.
Figure 8:
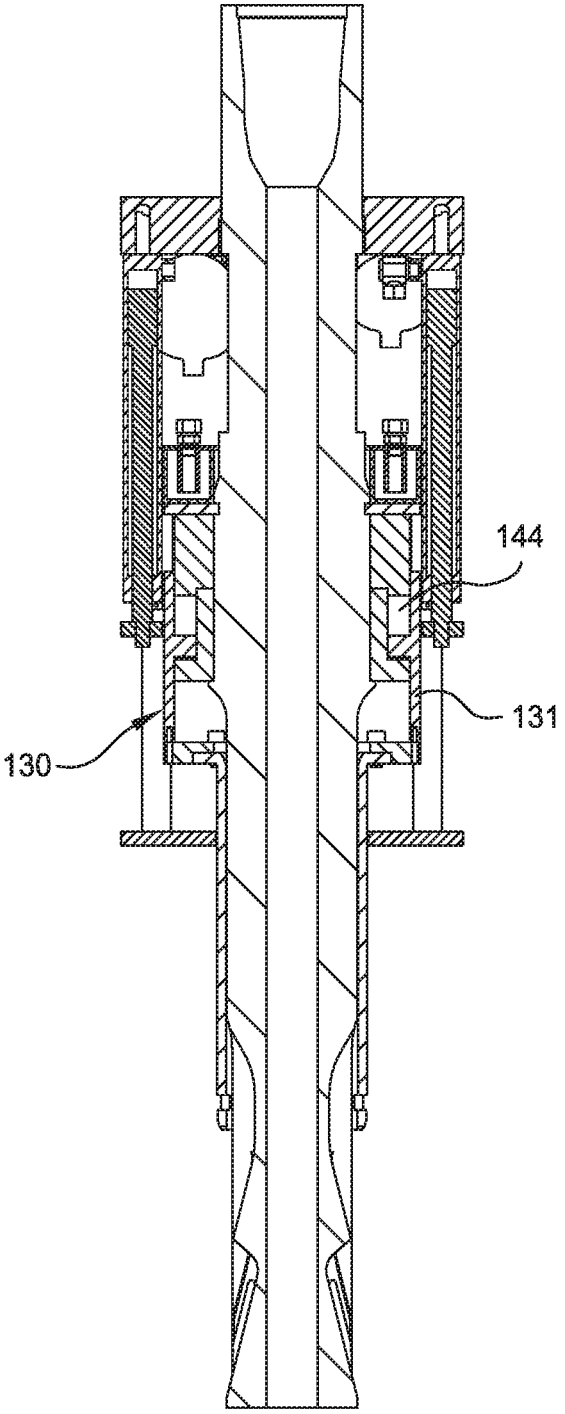
FIG. 8 is a cross-sectional view of the tubular handling apparatus of FIG. 7.
Figure 9:
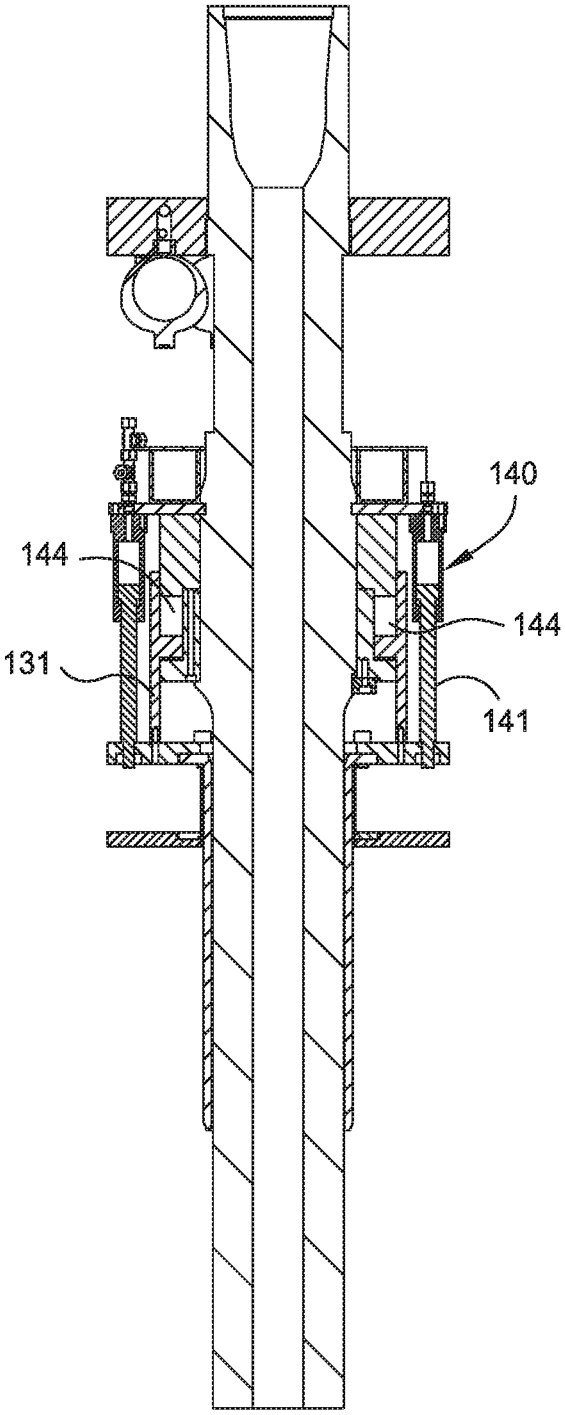
FIG. 9 is a cross-sectional view of the tubular handling apparatus rotated 90° from FIG. 8.

To set the gripping elements 157, the first accumulator 170A is opened to supply fluid to activate the setting cylinders 140. In one example, an operator operates the remote control to activate a first valve 271A to allow fluid communication through line 270A. In one embodiment, the first valve 271A is a directional valve, which may be powered by a battery. As shown in the circuit 200, the first valve 271A is in the closed position wherein communication through line 270A is blocked, and the line 270A from below the first valve 271A is connected to the tank 160. Upon activation, the first valve 271A is moved to right to allow fluid communication through line 270A, thereby allowing fluid from the first accumulator 170A to flow into the setting cylinders 140. The inflow of fluid causes the pistons 141 of the setting cylinders 140 to extend. Extension of the pistons 141 moves the actuator plate 156 and the actuator pipe 155 downward along the mandrel 110, and the gripping elements 157 are moved outwardly to engage an interior surface of the tubular 101. FIG. 7 shows the pistons 141 of the setting cylinders 140 in the extended position. FIG. 8 is a cross-sectional view of the tubular handling apparatus 100 of FIG. 7. FIG. 9 is a cross-sectional view of the tubular handling apparatus 100 rotated 90° from FIG. 8.

Because the rod 131 of the clamping cylinder 130 is attached to the actuator plate 156, the rod 131 is moved downward along with the actuator plate 156 when the setting cylinders 140 move the actuator plate 156. FIGS. 7-9 show the rod 131 in the extended position. As the rod 131 moves downward, fluid from the tank 160 is drawn into a chamber 144 in the clamping cylinder 130 via line 260.

After the setting cylinders 140 are set, fluid supplied from the first accumulator 170A continues to increase pressure in the setting cylinder 140. The remote control is then operated to activate the second valve 271B to allow fluid communication through line 270B. In another embodiment, the pressure increase due to the first accumulator 170A is above the threshold of the pressure relief valve 230. After the pressure relief valve 230 opens, fluid is supplied via line 235 to activate the second valve 271B.

Upon activation, the second valve 271B is moved to the left to allow communication through line 270B. In this respect, fluid from the second accumulator 170B is supplied to increase the pressure in the clamping cylinder 130 and the setting cylinders 140. In this embodiment, although the pressure is increased, the pistons 141 and rod 131 are not extended further. The pressure increases until the setting pressure is reached. At the setting pressure, the force required to grip the tubular to perform various operations is met.

In one exemplary operation, torque from the top drive is applied to the tubular handling apparatus 100 to rotate the tubular 101 to make up to or break out from another tubular. In another example, after connection, an axial force can be applied to the tubular handling apparatus 100 to raise or lift the tubular 101.

After completing the desired operation, the third valve 271C is activated to allow fluid communication through line 270C. In one example, the third valve 271C is activated using a remote control. Activating the third valve 271C also deactivates the first and second valves 271A, 271B. The third accumulator 170C supplies fluid to the piston side of the setting cylinder 140 to retract the piston 141. As a result, fluid in the setting cylinders 140 and the clamping cylinder 130 are forced to return to the tank 160. Retraction of the piston 141 disengages the gripping elements 157 from the tubular 101.

Fluid from the third accumulator 170C also flows into line 240 and line 245. Fluid in line 240 opens the check valve 275 in line 270A, thereby allowing fluid to from the setting cylinder 140 to return to the first valve 271A. In the closed position, the first valve 271A directs the returning fluid to the tank 160. Fluid in line 245 opens the check valve 265 in line 260, thereby allowing fluid from the clamping cylinder 130 to return to the tank 260.

After retracting the setting pistons 141, the tubular handling apparatus 100 is lifted upward relative to the tubular 101. The pistons 121 of the activating cylinders 120 will extend under the force of gravity. The activating cylinders 120 may include an optional spring 123 to urge the pistons 121 to extend. Upon extension of the pistons 121, fluid from the tank 160 will be drawn into the activating cylinders 120. The tubular handling apparatus 100 is ready for the next operation. In one embodiment, the piston sensor can detect the pistons 121 have fully extended and deactivate the third valve 271C.

Figure 11:
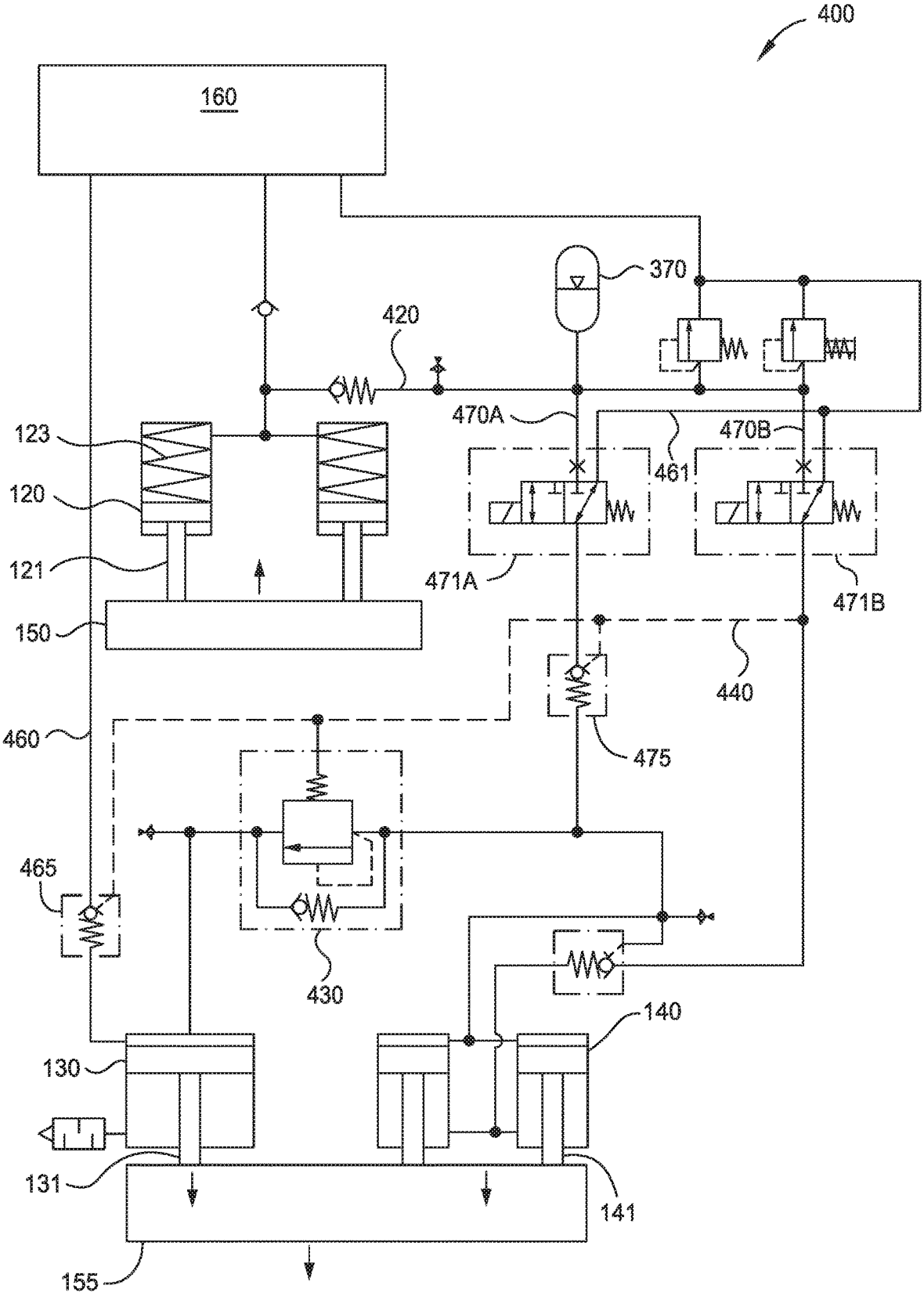
FIG. 11 shows another exemplary hydraulic circuit for the operation of the tubular handling apparatus of FIG. 1.

FIG. 11 shows another exemplary hydraulic circuit 400 for the operation of the tubular handling apparatus. The circuit 400 uses a single accumulator 370. For sake of clarity, features similar to the hydraulic circuit 200 of FIG. 10 are similarly numbered and will not be further described in detail. Although the circuits 200, 400 are different, the circuit 400 will described with reference to the tubular handling apparatus 100. In one embodiment, the tubular handling apparatus 100 is operated by a controller, such as a handheld remote control. In one embodiment, the circuit 400 is a closed fluid circuit.

To grip a tubular 101, the top drive lowers the tubular handling apparatus 100 toward the tubular 101, and the gripping elements 157 are inserted into the tubular 101. The apparatus 100 is lowered until the engagement plate 150 contacts the tubular 101. Thereafter, the top drive applies additional downward force to compress the activating cylinders 120 against the tubular 101, thereby retracting the pistons 121. FIGS. 4-6 show the pistons 121 of the activating cylinders 120 in the retracted position. As the pistons 121 retract, hydraulic fluid in the activating cylinders 120 is forced out of the activating cylinders 120 and is directed toward the accumulator 370 via fluid line 420. A piston sensor may be used to determine the pistons 121 have retracted. In one embodiment, the pistons 121 are not fully retracted to prevent a "wedge lock" of the gripping elements 157. One or more pressure sensors may be used to determine the accumulator 370 has reached the pressure required to operate the other cylinders, such as the setting cylinders 140 and the clamping cylinder 130. In one embodiment, the piston sensors and the pressure sensors are battery powered.

To set the gripping elements 157, the accumulator 370 is opened to supply fluid to activate the setting cylinders 140. In one example, an operator operates the remote control to activate a first valve 471A to allow fluid communication through line 470A. In one embodiment, the first valve 471A is a directional valve, which may be powered by a battery. As shown in the circuit 400, the first valve 471A is in the closed position wherein communication through line 470A is blocked, and the line 470A from below the first valve 471A is in communication with the tank 160 via line 461. Upon activation, the first valve 471A is moved to right to allow fluid communication through line 470A, thereby allowing fluid from the accumulator 370 to flow into the setting cylinders 140. The inflow of fluid causes the pistons 141 of the setting cylinders 140 to extend. Extension of the pistons 141 moves the actuator plate 156 and the actuator pipe 155 downward along the mandrel 110, and the gripping elements 157 are moved outwardly to engage an interior surface of the tubular 101. FIGS. 7-9 show the pistons 141 of the setting cylinders 140 in the extended position.

Because the rod 131 of the clamping cylinder 130 is attached to the actuator plate 156, the rod 131 is moved downward along with the actuator plate 156 when the setting cylinders 140 move the actuator plate 156. FIGS. 7-9 show the rod 131 in the extended position. As the rod 131 moves downward, fluid from the tank 160 is drawn into a chamber 144 in the clamping cylinder 130 via line 460.

After the setting cylinders 140 are set, fluid supplied from the accumulator 370 continues to increase pressure in the setting cylinder 140. When the pressure increase is above the threshold (for example, 130 bar) of the pressure relief valve 430, the pressure relief valve 430 opens to place line 470A in communication with the clamping cylinder 130. In this respect, fluid from the accumulator 370 is supplied to increase the pressure in the clamping cylinder 130. In this embodiment, although the pressure is increased, the pistons 141 and rod 131 are not extended further. The pressure increases until the setting pressure is reached. At the setting pressure, the force required to grip the tubular to perform various operations is met.

In one exemplary operation, torque from the top drive is applied to the tubular handling apparatus 100 to rotate the tubular 101 to make up to or break out from another tubular. In another example, after connection of the tubular 101 to another tubular, an axial force can be applied to the tubular handling apparatus 100 to raise or lift the tubular 101.

After completing the desired operation, the second valve 471B is activated to allow fluid communication through line 470B. In one example, the second valve 471B is activated using a remote control. Activating the second valve 471B also deactivates the first valve 471A. The accumulator 370 supplies fluid to the piston side of the setting cylinder 140 to retract the piston 141. As a result, fluid in the setting cylinders 140 and the clamping cylinder 130 are forced to return to the tank 160. Retraction of the piston 141 disengages the gripping elements 157 from the tubular 101.

Fluid from the accumulator 370 also flows into line 440. Fluid in line 440 opens the check valve 475 in line 470A, thereby allowing fluid to from the setting cylinder 140 to return to the first valve 471A. In the closed position, the first valve 471A directs the returning fluid to the tank 160 via line 461. Fluid in line 440 also opens the check valve 465 in line 460, thereby allowing fluid from the clamping cylinder 130 to return to the tank 160. Optionally, fluid in line 440 closes the relief valve 430.

After retracting the setting pistons 141, the tubular handling apparatus 100 is lifted upward relative to the tubular 101. The pistons 121 of the activating cylinders 120 will extend under the force of gravity. The activating cylinders 120 may include an optional spring 123 to urge the pistons 121 to extend. Upon extension of the pistons 121, fluid from the tank 160 will be drawn into the activating cylinders 120. The tubular handling apparatus 100 is ready for the next operation. In one embodiment, the piston sensor can detect the pistons 121 have fully extended and deactivate the second valve 471B.

In one embodiment, a tubular handling assembly includes a mandrel; a plurality of gripping elements for gripping a tubular, the plurality of gripping elements coupled to and rotatable with the mandrel; one or more accumulators; a first actuator configured to supply fluid to the one or more accumulators; and a second actuator configured to receive fluid from at least one of the one or more accumulators and to actuate the plurality of gripping elements.

In another embodiment, a tubular handling assembly includes a mandrel; a plurality of gripping elements for gripping a tubular, the plurality of gripping elements coupled to and rotatable with the mandrel; a plurality of accumulators; a first actuator configured to supply fluid to the plurality of accumulators; and a second actuator configured to receive fluid from at least one of the plurality of accumulators and to actuate the plurality of gripping elements.

In one or more embodiments described herein, the assembly includes a third actuator configured to actuate the plurality of gripping elements.

In one or more embodiments described herein, the second actuator is configured to activate the third actuator.

In one or more embodiments described herein, the third actuator comprises an annular rod.

In one or more embodiments described herein, a single accumulator supplies fluid to the second actuator and the third actuator.

In one or more embodiments described herein, the assembly includes a valve for controlling fluid communication between the accumulator and the third actuator.

In one or more embodiments described herein, the assembly includes a tank in selective fluid communication with the first actuator, the second actuator, and the third actuator.

In one or more embodiments described herein, the assembly includes a valve for controlling fluid communication between the second actuator and the at least one of the plurality of accumulators.

In one or more embodiments described herein, the one or more accumulators include a first accumulator and a second accumulator.

In one or more embodiments described herein, the second actuator is activated by fluid from the first accumulator.

In one or more embodiments described herein, the second actuator is deactivated by fluid from the second accumulator.

In one or more embodiments described herein, the assembly includes a remote controller for operating the assembly.

In one or more embodiments described herein, the assembly includes three accumulators.

In one or more embodiments described herein, the assembly includes a single accumulator.

In one or more embodiments described herein, a fluid circuit of the tubular handling assembly is a closed fluid circuit.

In another embodiment, a method of handling a tubular includes supplying fluid from a first actuator to an accumulator; supplying fluid from the accumulator to activate a second actuator; using the second actuator to activate a third actuator; moving a plurality of gripping elements into engagement with the tubular; and supplying fluid from the accumulator to increase a pressure of the third actuator.

In one or more embodiments described herein, the method includes supplying fluid from a tank to the third actuator when activated by the second actuator.

In one or more embodiments described herein, the method includes returning fluid to the tank when the second actuator is deactivated.

In one or more embodiments described herein, the method includes supplying fluid from the tank to the first actuator.

In one or more embodiments described herein, the method includes rotating the tubular to make up or break out a tubular connection with another tubular.

In one or more embodiments described herein, the method includes controlling fluid communication between the accumulator and the third actuator by activating or deactivating a valve.

In one or more embodiments described herein, the method includes controlling fluid communication between the accumulator and the second actuator by activating or deactivating a valve.

In one or more embodiments described herein, activating the second actuator comprises extending a piston of the second actuator.

In one or more embodiments described herein, using the second actuator to activate a third actuator comprises extending a rod of the third actuator while extending the piston of the second actuator.

In one or more embodiments described herein, supplying fluid from the actuator to the accumulator comprises compressing the first actuator against the tubular.

In another embodiment, a method of handling a tubular includes supplying fluid from a first actuator to a first accumulator and a second accumulator; supplying fluid from the first accumulator to activate a second actuator; using the second actuator to activate a third actuator; moving a plurality of gripping elements into engagement with the tubular; and supplying fluid from the second accumulator to deactivate the second actuator.

In one or more embodiments described herein, the method includes supplying fluid from a tank to the third actuator when activated by the second actuator.

In one or more embodiments described herein, the method includes returning fluid to the tank when the second actuator is deactivated.

In one or more embodiments described herein, the method includes supplying fluid from the tank to the first actuator.

In one or more embodiments described herein, the method includes supplying fluid from a third accumulator to increase a pressure in the third actuator.

In one or more embodiments described herein, the method includes rotating the tubular.

In one or more embodiments described herein, the method includes controlling fluid communication between the third accumulator and the third actuator by activating or deactivating a directional valve.

In one or more embodiments described herein, the method includes controlling fluid communication between the first accumulator and the second actuator by activating or deactivating a directional valve.

In one or more embodiments described herein, activating the second actuator comprises extending a piston of the second actuator.

In one or more embodiments described herein, using the second actuator to activate a third actuator comprises extending a rod of the third actuator while extending the piston of the second actuator.

In one or more embodiments described herein, supplying fluid from the first actuator to the first accumulator and the second accumulator comprises compressing the first actuator against the tubular.

While the foregoing is directed to embodiments of the invention, other and further embodiments of the invention may be devised without departing from the basic scope thereof, and the scope thereof is determined by the claims that follow.

The invention claimed is:

1. A tubular handling assembly, comprising:

a mandrel;

a plurality of gripping elements for gripping a tubular, the plurality of gripping elements coupled to and rotatable with the mandrel;

one or more accumulators;

a first actuator configured to compress against the tubular and supply fluid to the one or more accumulators; and a second actuator configured to receive fluid from at least one of the one or more accumulators and to actuate the plurality of gripping elements.

2. The assembly of claim 1, further comprising a third actuator configured to actuate the plurality of gripping elements.

3. The assembly of claim 2, wherein the second actuator is configured to activate the third actuator.

4. The assembly of claim 3, wherein the third actuator comprises an annular rod.

5. The assembly of claim 3, wherein a single accumulator supplies fluid to the second actuator and the third actuator.

6. The assembly of claim 5, further comprising a valve for controlling fluid communication between the accumulator and the third actuator.

7. The assembly of claim 3, further comprising a tank in selective fluid communication with the first actuator, the second actuator, and the third actuator.

8. The assembly of claim 1, further comprising a valve for controlling fluid communication between the second actuator and the at least one of the plurality of accumulators.

9. The assembly of claim 1, wherein the one or more accumulators includes a first accumulator and a second accumulator.

10. The assembly of claim 9, wherein the second actuator is activated by fluid from the first accumulator.

11. The assembly of claim 10, wherein the second actuator is deactivated by fluid from the second accumulator.

12. The assembly of claim 1, further comprising a remote controller for operating the assembly.

13. The assembly of claim 1, wherein the assembly includes a single accumulator.

14. The assembly of claim 11, further comprising a third actuator configured to actuate the plurality of gripping elements.

15. The assembly of claim 14, wherein the second actuator is configured to activate the third actuator.

16. A method of handling a tubular, comprising:

supplying fluid from a first actuator to an accumulator;

supplying fluid from the accumulator to activate a second actuator;

using the second actuator to activate a third actuator;

moving a plurality of gripping elements into engagement with the tubular; and supplying fluid from the accumulator to increase a pressure of the third actuator, wherein supplying fluid from the first actuator to the accumulator comprises compressing the first actuator against the tubular.

17. The method of claim 16, further comprising supplying fluid from a tank to the third actuator when activated by the second actuator.

18. The method of claim 17, further comprising returning fluid to the tank when the second actuator is deactivated.

19. The method of claim 18, further comprising supplying fluid from the tank to the first actuator.

20. The method of claim 16, further comprising controlling fluid communication between the accumulator and the second actuator by activating or deactivating a valve.

21. A method of handling a tubular, comprising:

supplying fluid from a first actuator comprising a piston and cylinder assembly to a first accumulator and a second accumulator;

supplying fluid from the first accumulator to activate a second actuator;

using the second actuator to activate a third actuator;

moving a plurality of gripping elements into engagement with the tubular; and supplying fluid from the second accumulator to deactivate the second actuator.

22. The method of claim 21, further comprising supplying fluid from a tank to the third actuator when activated by the second actuator.

23. The method of claim 21, further comprising supplying fluid from a third accumulator to increase a pressure in the third actuator.

* * * * *